US008157220B2

(12) United States Patent
Bonanni et al.

(10) Patent No.: US 8,157,220 B2
(45) Date of Patent: Apr. 17, 2012

(54) HOT RAIL WHEEL BEARING DETECTION SYSTEM AND METHOD

(75) Inventors: Pierino Gianni Bonanni, Loudonville, NY (US); Harry Kirk Mathews, Jr., Clifton Park, NY (US); John Erik Hershey, Ballston Lake, NY (US); Brock Estel Osborn, Niskayuna, NY (US)

(73) Assignee: Progress Rail Services Corp, Albertville, AL (US)

( * ) Notice: Subject to any disclaimer, the term of this patent is extended or adjusted under 35 U.S.C. 154(b) by 159 days.

(21) Appl. No.: 12/122,560

(22) Filed: May 16, 2008

(65) Prior Publication Data

US 2008/0283680 A1 Nov. 20, 2008

Related U.S. Application Data

(60) Provisional application No. 60/938,475, filed on May 17, 2007.

(51) Int. Cl.
*B61K 9/00* (2006.01)

(52) U.S. Cl. ..... 246/169 A; 246/169 D

(58) Field of Classification Search ..... 246/167 R, 246/169 A, 169 D; 250/339.04, 339.05; 340/682; 702/134, 135, 136, 40
See application file for complete search history.

(56) References Cited

U.S. PATENT DOCUMENTS

| | | | | |
|---|---|---|---|---|
| 3,731,087 | A | 5/1973 | King | |
| 4,313,583 | A | 2/1982 | Bambara et al. | |
| 5,201,483 | A | 4/1993 | Sutnar et al. | |
| 5,331,311 | A | 7/1994 | Doctor | |
| 5,381,700 | A | 1/1995 | Grosskopf, Jr. | |
| 5,448,072 | A | 9/1995 | Gallagher | |
| 5,677,533 | A | 10/1997 | Yaktine et al. | |
| 6,872,945 | B2 * | 3/2005 | Bartonek | 250/339.04 |
| 6,911,914 | B2 | 6/2005 | Mathews, Jr. et al. | |

* cited by examiner

*Primary Examiner* — Mark Le

(57) ABSTRACT

Hot rail car bearings or wheels are identified by sensing an infrared radiation from the hot surface and determining whether features of the sensed signals are indicative of hot rail car surfaces. The features may include the signals themselves, with distances or correlations being established between the signals and signals of known hot bearings or wheels. The features may be analyzed in a feature or decision space, with boundaries being established that identify hot bearings or wheels, or that establish false positive features or noise. The identification may also be implemented as a matched filter.

20 Claims, 4 Drawing Sheets

HOT RAIL WHEEL BEARING DETECTION SYSTEM AND METHOD

CROSS REFERENCE TO RELATED APPLICATIONS

This application is a non-provisional application of the provisional application Ser. No. 60/938,475, filed May 17, 2007, which is herein incorporated by reference.

BACKGROUND

The present invention relates generally to detection of abnormally hot rail car wheel bearing surfaces, and more specifically to signal processing of infrared signals emitted by hot surfaces of such bearings and surrounding structures.

Railcars riding on wheel trucks occasionally develop overheated bearings. The overheated bearings may eventually fail and cause costly disruption to rail service. Many railroads have installed wayside hot bearing detectors (HBDs) that view the bearings and surrounding structure surfaces as a rail car passes, and generate an alarm upon detection of an abnormally hot surface. One of the commonly used techniques includes employing sensors in the HBDs that sense heat generated by the bearing surfaces. For example, pyroelectric sensors may be used that depend upon the piezoelectric effect. However, such sensors can be susceptible to noise due to mechanical motion of the railcars. Such noise may result from so-called microphonic artifacts, and can complicate the correct diagnosis of hot bearings, or even cause false positive readings. In general, false positive readings, although false, nevertheless require stopping a train to verify whether the detected bearing is, in fact, overheating, leading to costly time delays and schedule perturbations.

Accordingly, an improved system and method that would address the aforementioned issues is needed.

BRIEF DESCRIPTION OF THE INVENTION

In accordance with one exemplary embodiment of the present invention, a method for detecting a moving hot bearing or wheel of a rail car comprises establishing features of sensor signals in a decision space, and establishing a relationship between the features for discriminating between abnormally hot bearings or wheels and bearings or wheels that are not abnormally hot. Signals are received that are representative of temperature of the moving bearing or wheel, and based upon the relationship and the signals, it is determined whether the bearing or wheel is likely hotter than desired.

In accordance with another exemplary embodiment of the present invention, a method for detecting a moving hot bearing or wheel of a rail car comprises establishing features of sensor signals in a decision space, and identifying a region in the decision space in which the features are indicative that a bearing or wheel is hotter than desired. Signals are then received that are representative of temperature of the moving bearing or wheel, and based upon the region and the signals, it is determined whether the bearing or wheel is likely hotter than desired.

The invention also provides a system for detecting a moving hot bearing or wheel of a rail car comprises a sensor configured to detect radiation from a moving hot bearing or wheel and to generate a signal representative of the radiation. The system also includes processing circuitry configured to receive signals from the sensors and to determine whether the bearing or wheel is likely hotter than desired based upon a relationship between the features in a decision space, the features permitting discriminating between abnormally hot bearings or wheels and bearings or wheels that are not abnormally hot.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
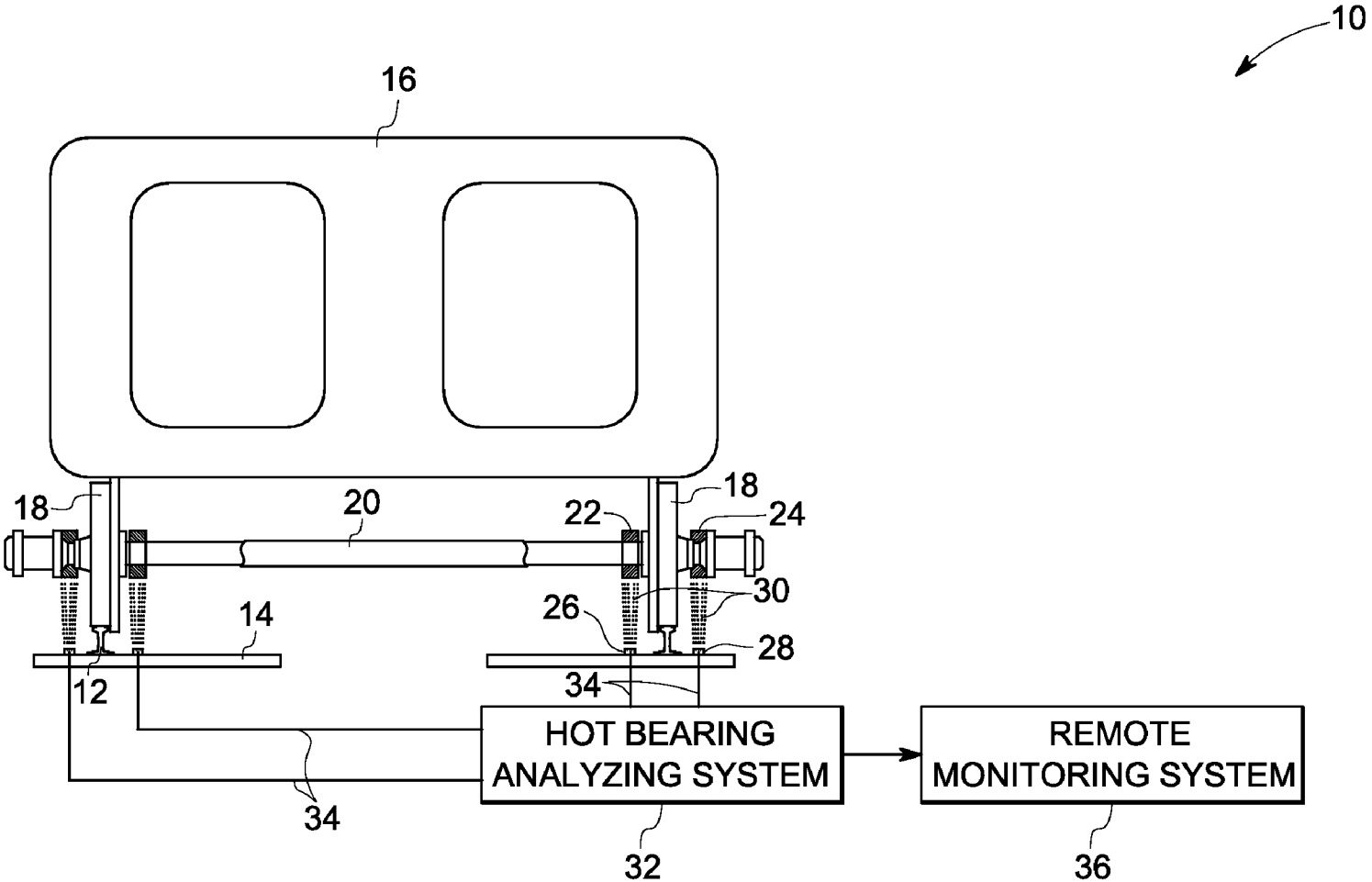
FIG. 1 is a diagrammatical representation of an exemplary system for detecting hot rail car bearings and wheel surfaces.

Referring now to the drawings, FIG. 1 illustrates an exemplary rail car bearing and wheel surface temperature detection system 10, shown disposed adjacent to a railroad rail 12 and a crosstie 14. A railway vehicle or car 16 includes multiple wheels 18, typically mounted in sets or trucks. An axle 20 connects wheels 18 on either side of the rail car. The wheels are mounted on and can freely rotate on the axle by virtue of bearings 22 and 24.

One or more sensors 26, 28 are disposed along a path of the railroad track to obtain data from the wheel bearings. As in the illustrated embodiment, an inner bearing sensor 26 and an outer bearing sensor 28 may be positioned in a rail bed on either side of the rail 12 adjacent to or on the cross tie 14 to receive infrared emission 30 from the bearings 22, 24. Examples of such sensors include, but are not limited to, infrared sensors, such as those that use pyrometer sensors to process signals. In general, such sensors detect radiation emitted by the bearings and/or wheels, which is indicative of the temperature of the bearings and/or wheels. In certain situations, the detected signals may require special filtering to adequately distinguish signals indicative of overheating of bearings from noise, such as microphonic noise. Such techniques are described below.

A wheel sensor (not shown) may be located inside or outside of rail 12 to detect the presence of a railway vehicle 16 or wheel 18. The wheel sensor may provide a signal to circuitry that detects and processes the signals from the bearing sensors, so as to initiate processing by a hot bearing or wheel analyzing system 32. In the illustrated embodiment, the bearing sensor signals are transmitted to the hot bearing analyzing system 32 by cables 34, although wireless transmission may also be envisaged. From these signals, the analyzing system 32 filters the received signals as described below, and determines whether the bearing is abnormally hot, and generates an alarm signal to notify the train operators that a hot bearing has been detected and is in need of verification and/or servicing. The alarm signal may then be transmitted to an operator room (not shown) by a remote monitoring system 36. Such signals may be provided to the on-board operations personnel or to monitoring equipment entirely remote from the train, or both.

Figure 2:
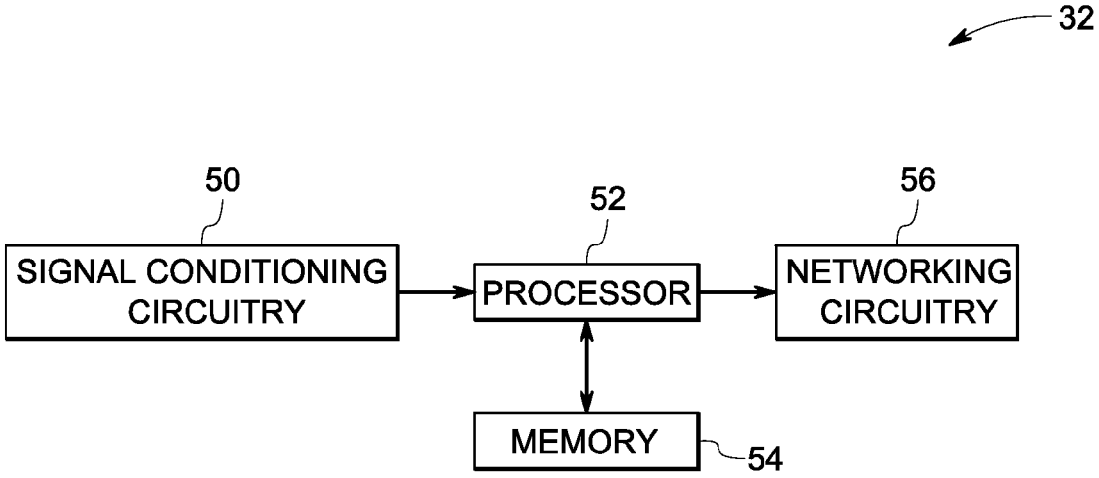
FIG. 2 is a diagrammatical representation of functional components of the hot bearings detection system of FIG. 1.

FIG. 2 is a diagrammatic representation of the functional components of the hot bearing analyzing system 32. The output of inner bearing sensor 26, outer bearing sensor 28 and the wheel sensor are processed via signal conditioning circuitry 50. Signal conditioning circuitry 50 may convert the sensor signals into digital signals, perform filtering of the signals, and the like. It should be noted that the circuitry used to detect and process the sensed signals, and to determine whether a bearing and/or wheel is hotter than desired, may be digital, analog, or a combination. Thus, where digital circuitry is used for processing, the conditioning circuitry will generally include analog-to-digital conversion, although analog processing components will generally not require such conversion.

Output signals from the signal conditioning circuitry are then transmitted to processing circuitry 52. The processing circuitry 52 may include digital components, such as a programmed microprocessor, field programmable gate array, application specific digital processor or the like, implementing routines as described below. It should be noted, however, that certain of the schemes outlined below are susceptible to analog implementation, and in such cases, circuitry 52 may include analog components. In one embodiment, the processor 52 includes a filter to eliminate noise from the electrical signal.

The processing circuitry 52 may have an input port (not shown) that may accept commands or data required for presetting the processing circuitry. An example of such an input is a decision threshold (e.g., a value above which a processed signal is considered indicative of an overheated bearing and/or wheel). The particular value assigned to any of the thresholds discussed herein may be chosen readily by those skilled in the art using basic techniques of signal detection theory, including, for example, analysis of the sensor system receiver operating characteristics. As an example, if the system places very high importance on minimizing missed detection (i.e., false negatives), the system may be set with lower thresholds so as to reduce the occurrence rate of missed detections to the maximum tolerable rate. On the other hand, the system thresholds may be set higher so as to reduce the rate of "false positives" while still achieving a desired detection rate, coinciding with maintaining an acceptable level of "false negatives". In general, and as described below, both types of false determinations may be reduced by the present processing schemes. As also described below, the system may implement an adaptive approach to setting of the thresholds, in which thresholds are set and reset over time to minimize both false negative and false positive alarms.

When digital circuitry is used for processing, the processing circuitry will include or be provided with memory 54. In one embodiment processing circuitry 52 utilizes programming, and may operate in conjunction with analytically or experimentally derived radiation data stored in the memory 54. Moreover, memory 54 may store data for particular trains, including information for each passing vehicle, such as axle counts, and indications of bearings and/or wheels in the counts that appear to be near or over desired temperature limits. Processed information, such as information identifying an overheated bearing or other conditions of a sensed wheel bearing, may be transmitted via networking circuitry 56 to a remote monitoring system 36 for reporting and/or notifying system monitors and operators of degraded bearing conditions requiring servicing.

The present techniques provide for determination of whether a rail car bearing or wheel is abnormally hot based upon establishment of features of such abnormally hot bearings or wheels in a decision space, and establishment of a decision boundary that can be used to determine, as sensed signals are received, whether passing bearings and wheels are abnormally hot. As discussed below, the features may vary, and may be as few as a single feature (compared to a threshold, which serves as the decision boundary), or many features may be used. Moreover, the features may be postulated based upon heuristics using known data to establish one or more regions in the decision space corresponding to hot bearings or wheels (or conversely disqualifying sensed data from that determination, such as to reduce false positive alarms), in a technique that may be called "clustering." Similarly, the technique may establish a decision boundary based upon a model approach, in which components of signals may be considered in a feature space, and relationships identified that correspond to "nominal" hot bearings for which an alarm should be raised, and "noise" which should be rejected. Special cases of the latter approach may actually use the data points themselves as features, and compute "distances" or correlations between later received signals and those reference features to determine whether received signals are closer to references for hot bearings, or to known noise. This type of filter may be implemented as a "correlation receiver" or as a "matched filter". In certain implementations such filters may employ a transfer function with a system impulse response matching that of the known valid alarm response so as to output an alarm signal when input signals correspond to an abnormally hot bearing or wheel.

Figure 3:
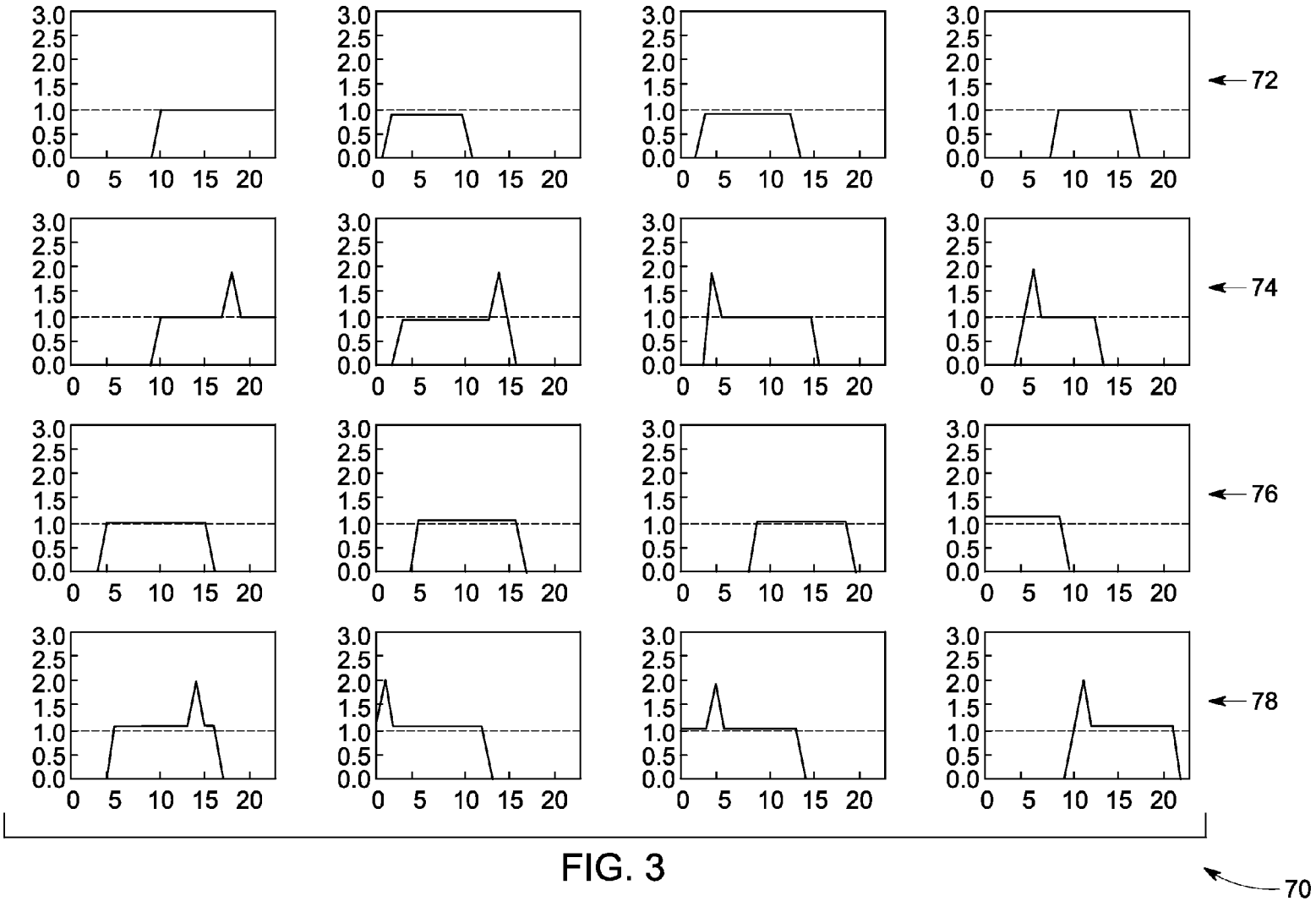
FIG. 3 illustrates sixteen examples of 24-point sensor signal output plot.

FIG. 3 is a diagram illustrating a series of exemplary plots of sensed signals over time that could be used to establish clustered features in a decision space as a basis for establishing a decision boundary. The figure illustrates sixteen examples of 24-point output 70 of the wheel sensor or the bearing sensor 26, 28 of FIG. 2. The sensor outputs a signal having elevated values (e.g., more than 1 in the illustration) if the detected surface is abnormally hot, and if not it will output lower values (e.g., less than 1). In all plots, the horizontal axis represents time and the vertical axis represents sensor output. The four cases in the top row 72 are the sensor signals for a non-abnormally hot rail car surface without artifacts. The second row 74 is for the case of a non-abnormally hot rail car surface and with artifacts. The third row 76 is for the case of an abnormally hot rail car surface without artifacts. The fourth row 78 is for the case of an abnormally hot rail car surface with artifacts.

Figure 4:
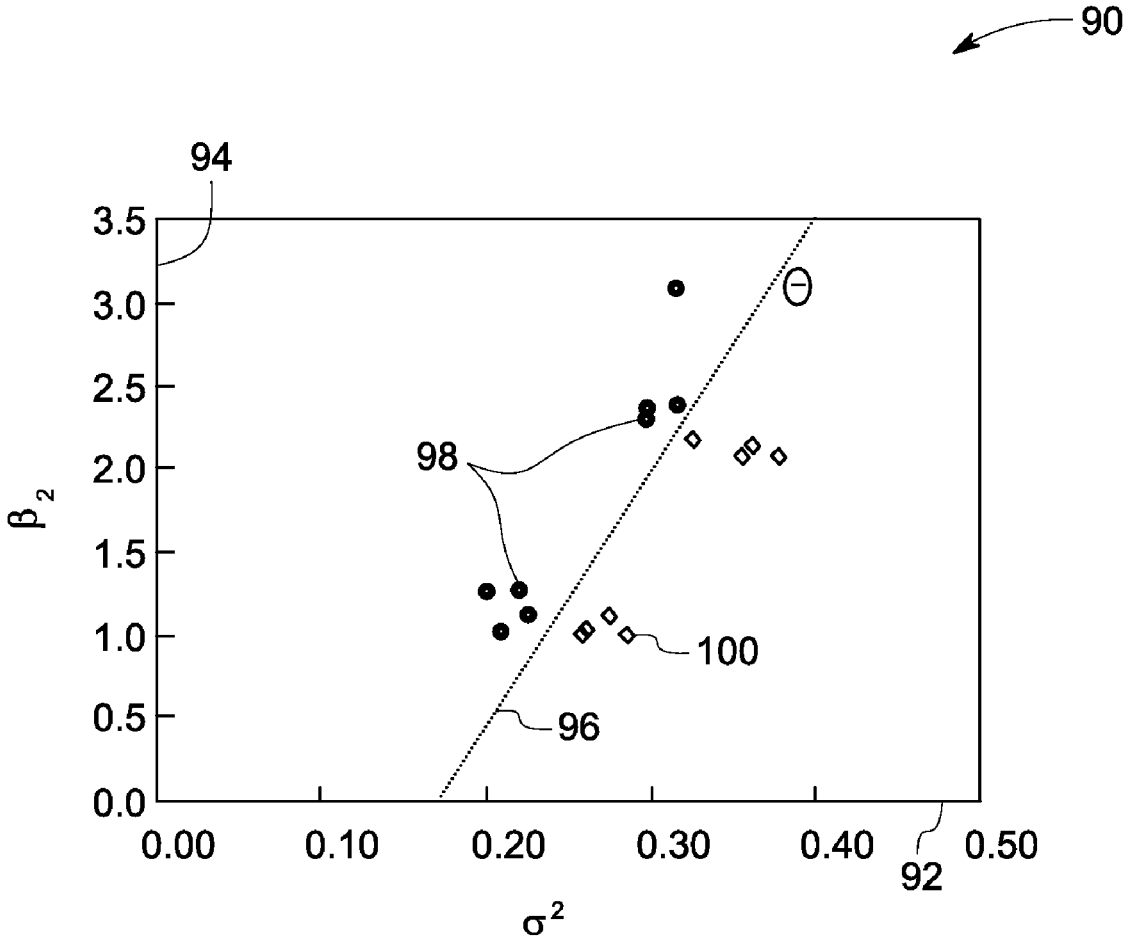
FIG. 4 represents a plot of separation of non-abnormally and abnormally hot rail car bearings and wheel surfaces, in accordance with one embodiment of the present invention.

FIG. 4 represents a plot 90 of separation of non-abnormally and abnormally hot rail car bearing or wheel surface examples of FIG. 3, in accordance with a clustering based filter of the present invention. The clustering based filter differentiates non-abnormally hot and abnormally hot rail car bearing or wheel surface based on decision threshold. A sensor viewing a rail car bearing or wheel surface that is not abnormally hot outputs a signal that has lower average power $\sigma^2$ than if the sensor is viewing an abnormally hot rail car bearing or wheel surface. However, if the sensor is viewing a rail car bearing or wheel surface that is not abnormally hot, but has an artifact (such as a spike or impulse), then the average power of the sensor signal output may be higher than the case when there is no artifact present in the sensor output signal. Thus, a decision based just on average power alone might be expected to be incorrect with a non-insignificant probability. If the dimension of the decision space is increased by a combination of average power and one or more other features gained through signal processing, then the probability of an incorrect decision is significantly reduced. As an example, and not by way of limitation, a suitable additional feature is a normalized fourth moment, known in the signal processing art as the kurtosis, often in the art designated as $\beta$.

Horizontal axis 92 in the plot 90 of FIG. 4 represents the average power $\sigma^2$ of the sensor output signal. Vertical axis 94 in the plot represents normalized fourth moment β of the sensor output signal. The straight line 96 in the plot is a decision threshold Θ. In general, a decision threshold may be any surface of appropriate dimension that efficiently partitions abnormally hot and non-abnormally hot rail car surfaces. In this embodiment, the decision threshold Θ, is a linear surface or straight line. In another embodiment, threshold surface is a 2-dimensional surface. In the plot 90, circles 98 represent measurements points from the non-abnormally hot railcar wheel or bearing surfaces and diamonds 100 represent measurement points from the abnormally hot rail car wheel or bearing surfaces. A decision threshold Θ successfully partitions all of the non-abnormally hot rail car surfaces from the abnormally hot rail car wheel or bearing surfaces.

It may be noted that the approach summarized in FIGS. 3 and 4 allows for identification of features, such as signal strength or amplitude, and the establishment of a decision boundary later used to decide whether received signals represent abnormally hot bearings or wheels. It should be noted that a range of such features may be considered, however, as the plots of FIG. 3 reflect. For example, such features may include signal amplitude, duration or persistence of the signal at an elevated level, whether peaks precede or follow other signals at an elevated level (e.g., possibly indicative of sunlight directly impacting the sensors or reflected to impact the sensors), average power, and so forth. The data may also indicate known false positive patterns (e.g., sunlight passing between 2 rail cars) that may be excluded from generating alarms. In short, the decision space may be more complex, and the decision boundaries may include multiple regions or zones (including in multi-dimensional feature space) that correspond to feature combinations that should generate alarms, and to other combinations (or even combinations within these) that should not.

In a similar approach, discretized samples may be considered in a window of samples so as to form a vector of samples. This vector may be reduced, where desired, or all samples within the window may be used. The samples may be described as results of components in the feature space (e.g., impulses, broader signals, etc.), and a model may be determined that identifies relationships between the samples known to correspond to "nominally" abnormally hot bearings or wheels, for which an alarm should be generated, as opposed to "noise", for which no alarm is needed.

Moreover, in certain cases, the features may consist of the sampled data itself, with each considered point of data representing a feature in the decision space. Relationships may be established, then between the features that permit discrimination of abnormally hot bearings or wheels from those that are not abnormally hot. Distance formulae or correlations may be used to compare or contrast later received signals from these reference features to determine whether to generate an alarm. In such cases, depending upon the relative distance of the received signals from known hot bearing features, or conversely from known noise, a decision is made whether to generate the alarm. Larger or more complex correlations may be established, such as to account for more complex or particular shapes of features (such as those illustrated in FIG. 3).

The former filter may be implemented as a "correlation receiver". Such correlation receivers have been applied generally in signal filtering arts but never applied to the detection of hot rail car bearing and wheel detection. The filter may also take the form of a "matched filter". In such approaches, a system or transfer function may be defined that has an impulse response that matches the desired output, in this case, the generation of an alarm when input signals are received that correspond to signatures or patterns for abnormally hot bearings or wheels, and not when other data or noise patterns are received. In such cases, the filter would be established and tested that provides the desired response, then signals may be fed to it in real time, or delayed by a desired delay.

In the filtering approaches described above, the decision boundaries and thresholds may be fixed, or can be adjusted dynamically. In a case of a single feature, for example, the decision boundary may be a simple threshold (e.g., a signal level or persistence duration). In more complex implementations, multiple thresholds may define areas or regions within the multidimensional feature space (the decision space). Such boundaries or thresholds may be adjusted during operation of the system, where desired, such as via a first in first out (FIFO) window initialized at a beginning point in the analysis of incoming signals. The FIFO window contains the decisions regarding the differentiation of abnormally hot rail car bearings and/or wheels and normally hot rail car surfaces. Old values of thresholds are removed and new values are updated. Decisions regarding the differentiation of abnormally hot rail car surfaces and normally hot rail car surfaces are then made. Based upon a relationship between the rate at which alarms are generated in the FIFO window and the number of "positive" decisions made (identifying a wheel or bearing as abnormally hot), then the decision threshold(s) may be increased. Similar logic may be used for decreasing the thresholds or maintaining them fixed.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method for detecting a moving hot bearing or wheel of a rail car comprising:

(a) establishing features of sensor signals in a multidimensional decision space;

(b) establishing a multidimensional threshold for discriminating between abnormally hot bearings or wheels and bearings or wheels that are not abnormally hot, wherein the multidimensional threshold is based on an average power of the sensor signals and a normalized fourth moment of the sensor signals;

(c) receiving signals representative of temperature of the moving bearing or wheel; and (d) determining whether the bearing or wheel is likely hotter than desired based upon the multidimensional threshold and the signals.

2. The method of claim 1, wherein establishing the multidimensional threshold for discriminating between abnormally hot bearings or wheels and bearings or wheels that are not abnormally hot includes establishing the multidimensional threshold based on analysis of clustering of the features in the multidimensional decision space.

3. The method of claim 1, wherein establishing the multidimensional threshold for discriminating between abnormally hot bearings or wheels and bearings or wheels includes identifying a region in the multidimensional decision space in which the features are indicative that a bearing or wheel is hotter than desired.

4. The method of claim 3, wherein establishing the multidimensional threshold for discriminating between abnormally hot bearings or wheels and bearings or wheels includes identifying a region in the multidimensional decision space in which the features are not indicative that a bearing or wheel is hotter than desired.

5. The method of claim 3, further comprising adjusting a boundary of the region.

6. The method of claim 5, wherein the decision boundary is adjusted based upon a FIFO analysis of decisions.

7. The method of claim 1, further including determining a set of features indicative that a bearing or wheel is hotter than desired, and determining a distance between sampled sensor signals and the set of features.

8. The method of claim 1, further including determining a set of features indicative that a bearing or wheel is hotter than desired, and determining a correspondence between sampled sensor signals and the set of features.

9. The method of claim 1, further including establishing a matched filter having an impulse response that provides an output indicative that a bearing or wheel is hotter than desired.

10. The method of claim 1, wherein the features include at least one of signal amplitude, signal persistence at an elevated level, a waveform shape, and average power.

11. The method of claim 1, wherein establishing the multidimensional threshold includes determining the multidimensional threshold based on at least one of signal amplitude, duration of the signal at an elevated level, the presence of peaks in the signal, average power, and known false positive patterns.

12. The method of claim 1, wherein the features include sampled sensor signals.

13. A method for detecting a moving hot bearing or wheel of a rail car comprising:

(a) establishing features of sensor signals in a multidimensional decision space;

(b) identifying a multidimensional region in the multidimensional decision space in which the features are indicative that a bearing or wheel is hotter than desired, including identifying a multidimensional decision threshold for discriminating between abnormally hot bearings or wheels and bearings or wheels that are not abnormally hot, wherein the multidimensional decision threshold is based on an average power of the sensor signals and a normalized fourth moment of the sensor signals;

(c) receiving signals representative of temperature of the moving bearing or wheel; and (d) determining whether the bearing or wheel is likely hotter than desired based upon the multidimensional decision threshold and the signals.

14. The method of claim 13, wherein step (b) includes identifying the multidimensional decision threshold by analysis of clustering of the features in the multidimensional decision space.

15. The method of claim 13, further including identifying a region in the multidimensional decision space in which the features are not indicative that a bearing or wheel is hotter than desired.

16. The method of claim 13, further comprising adjusting a boundary of the region.

17. The method of claim 16, wherein the decision boundary is adjusted based upon a FIFO analysis of decisions.

18. A system for detecting a moving hot bearing or wheel of a rail car comprising:

a sensor configured to detect radiation from a moving hot bearing or wheel and to generate a signal representative of the radiation; and processing circuitry configured to receive signals from the sensors and to determine whether the bearing or wheel is likely hotter than desired based upon a relationship between the features in a multidimensional decision space and a multidimensional threshold, wherein the multidimensional threshold is based on an average power of the sensor signals and a normalized fourth moment of the sensor signals, and the features permit discriminating between abnormally hot bearings or wheels and bearings or wheels that are not abnormally hot.

19. The system of claim 18, wherein the processing circuitry is configured to establish the relationship between the features in the multidimensional decision space.

20. The system of claim 18, wherein the features include at least one of signal amplitude, signal persistence at an elevated level, a waveform shape, and average power.

* * * * *